US008435925B2

(12) United States Patent
Dontula et al.

(10) Patent No.: US 8,435,925 B2
(45) **Date of Patent: *May 7, 2013**

(54) THERMAL RECEIVER ELEMENTS AND IMAGING ASSEMBLIES

(75) Inventors: Narasimharao Dontula, Rochester, NY (US); Somsack Chang, Pittsford, NY (US); Jeffrey R. Gillmor, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 392 days.

This patent is subject to a terminal disclaimer.

(21) Appl. No.: 12/823,187

(22) Filed: Jun. 25, 2010

(65) Prior Publication Data

US 2011/0318491 A1 Dec. 29, 2011

(51) Int. Cl.
*B41M 5/50* (2006.01)

(52) U.S. Cl.
USPC ..... 503/227

(58) Field of Classification Search ..... None
See application file for complete search history.

(56) References Cited

U.S. PATENT DOCUMENTS

| | | | |
|---|---|---|---|
| 4,734,396 | A | 3/1988 | Harrison et al. |
| 4,837,200 | A | 6/1989 | Kondo et al. |
| 5,244,861 | A | 9/1993 | Campbell et al. |
| 5,407,894 | A | 4/1995 | Hayashi et al. |
| 5,821,028 | A | 10/1998 | Maejima et al. |
| 6,372,689 | B1 | 4/2002 | Kuga et al. |
| 2008/0220190 | A1 | 9/2008 | Majumdar et al. |

FOREIGN PATENT DOCUMENTS

| | | | |
|---|---|---|---|
| JP | 03-184893 | * | 8/1991 |
| JP | 07-137465 | | 5/1995 |
| WO | 2010151316 | | 12/2010 |

OTHER PUBLICATIONS

U.S. Appl. No. 12/490,464, filed Jun. 24, 2009 titled Extruded Image Receiver Elements by Dontula et al.
U.S. Appl. No. 12/490,455, filed Jun. 24, 2009 titled Method of Making Thermal Imaging Elements by Dontula et al.
U.S. Appl. No. 12/581,921, filed Oct. 20, 2009 titled Thermal Dye Image Receiver Elements by Majumdar et al.
U.S. Appl. No. 12/548,476, filed Aug. 27, 2009 titled Image Receiver Elements by Dontula et al.

* cited by examiner

*Primary Examiner* — Bruce H Hess
(74) *Attorney, Agent, or Firm* — J. Lanny Tucker

(57) ABSTRACT

An imaging element has a substrate, an extruded, non-voided compliant layer and an image receiving layer. The extruded, non-voided compliant layer has a heat of fusion of equal to or greater than 0 and up to and including 45 joules/g of compliant layer as determined in a temperature range of from 25° C. to 147° C. by ASTM method D3418-08 and a tensile modulus value of less than $5\times10^{10}$ dynes/cm$^2$. These imaging elements can be used as thermal dye image transfer receiver elements to provide an image in combination with a thermal dye donor element in a thermal dye transfer process.

19 Claims, No Drawings

THERMAL RECEIVER ELEMENTS AND IMAGING ASSEMBLIES

FIELD OF THE INVENTION

The present invention relates to image receiver elements such as thermal dye transfer receiver elements in which an extruded, non-voided compliant layer is adhered to an image receiving layer that can also be extruded. The invention also provides thermal imaging assemblies having the image receiver element of this invention.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Dye receiver elements used in thermal dye transfer generally include a support (transparent or reflective) bearing on one side thereof a dye image-receiving layer, and optionally additional layers, such as a compliant or cushioning layer between the support and the dye receiving layer. The compliant layer provides insulation to keep heat generated by the thermal head at the surface of the print, and also provides close contact between the donor ribbon and receiving sheet which is essential for uniform print quality.

Various approaches have been suggested for providing such a compliant layer. U.S. Pat. No. 5,244,861 (Campbell et al.) describes a composite film comprising a microvoided core layer and at least one substantially void-free thermoplastic skin layer. Such an approach adds an additional manufacturing step of laminating the composite film to the support, and film uniformity can be variable resulting in high waste factors. U.S. Pat. No. 6,372,689 (Kuga et al.) describes the use of a hollow particle layer between the support and dye receiving layer. Such hollow particles layers are frequently coated from aqueous solutions that necessitate a powerful drying stage in the manufacturing process and can reduce productivity. In addition, the hollow particles can result in increased surface roughness in the finished print that reduces surface gloss. It would be advantageous to provide a compliant layer that enables a high gloss print to be obtained. It would also be advantageous if the technology used to provide such a compliant layer also enables a matte-like print to be obtained if a low gloss finish is desired. It would be further advantageous if this low gloss finish can further be enhanced by the incorporation of additives like matte beads in an aqueous subbing layer.

Copending and commonly assigned U.S. Ser. Nos. 12/490,455 and 12/490,464 (both filed Jun. 24, 2009 by Dontula et al.) describe imaging elements having multiple extruded layers included extruded compliant and antistatic subbing layers.

The image receiving layer can be extruded or coated out of an organic solvent. Two or more of such layers can be co-extruded if desired along with optional extruded skin layers.

In addition, U.S. Patent Application Publication 2008/0220190 (Majumdar et al.) describes image recording elements comprising a support having thereon an aqueous subbing layer and an extruded dye receiving layer.

U.S. Pat. No. 4,734,396 (Harrison et al.) describes a dye-receiving element having a solvent-coated compression layer between the support and the dye image-receiving layer to reduce image defects. The compression layer has a compression modulus of less than $350\times10^6$ Pascals as determined using a tensile testing machine. The compression layer can comprise a variety of polymers including acrylics, modified polyesters, polydienes and polystyrene foam.

Intermediate layers coated out of aqueous solutions are described for image-receiving elements in U.S. Pat. No. 4,837,200 (Kondo et al.).

U.S. Pat. No. 5,407,894 (Hayashi et al.) describes thermal transfer dye image receiving sheets that have thermoplastic resin coatings on a substrate paper base.

Moreover, U.S. Pat. No. 5,821,028 (Maejima et al.) describes cushioning layers containing various elastomeric resins in thermal transfer image receiving materials.

Despite the advances in the art, there remains a need to simplify the construction of thermal dye transfer receiver elements by eliminating antistatic layers between the substrate and image receiving layer. Yet, this advantage is desired without any loss of thermal imaging or increase in image defects.

Copending and commonly assigned U.S. Ser. Nos. 12/581,921 (filed Oct. 20, 2009 by Majumdar, Honan, and Weidner) and 12/490,464 (filed Jun. 24, 2009, by Dontula, Chang, and Thomas) describe thermal dye transfer receiver elements that include an extruded compliant layer and an antistatic layer adhering it to an image receiving layer.

Commercial image transfer elements sold as Kodak® Xtralife® and Xtralife® II include voided compliant layers attached to an image receiving layer. While the voided nature of the compliant layer provides certain advantages, there is a need to provide a less expensive alternative without sacrificing image transfer and image density.

SUMMARY OF THE INVENTION

This invention provides an imaging element consisting essentially of a substrate and on the same surface, in order:

an extruded, non-voided compliant layer, and an image receiving layer, and optionally a skin layer between the extruded, non-voided compliant layer and the image receiving layer, wherein the extruded, non-voided compliant layer has a heat of fusion (enthalpy of fusion) of equal to or greater than 0 and up to and including 45 joules/g of compliant layer as determined in the temperature range of from 25° C. to 147° C. by ASTM method D3418-08, and a tensile modulus value of from $7\times10^7$ to $5\times10^{10}$ dynes/cm$^2$.

In some embodiments, a thermal dye transfer element consists essentially of a substrate comprising a raw paper base, and having on the same surface, only the following layers, in order:

a) an extruded, non-voided compliant layer comprising:

from about 35 to about 80 weight % of a matrix polymer derived at least in part from a polyolefin, from about 10 to about 25 weight % of at least one elastomeric polymer that is a thermoplastic polyolefin blend, styrene/alkylene block copolymer, polyether block polyamide, copolyester elastomer, ethylene/propylene copolymer, or thermoplastic urethane, and from about 5 to about 20 weight % of at least one amorphous or semi-crystalline polymer that is a polystyrene, polypropylene, or cyclic olefin copolymers, b) a thermal dye image receiving layer comprising a polyester, polycarbonate, vinyl polymer, or a combination thereof, and c) a co-extruded skin layer immediately adjacent on either or both sides of the extruded, non-voided compliant layer, wherein the extruded thermoplastic resin compliant layer has a heat of fusion of from 5 to 45 joules/g of compliant layer as determined in the temperature range of from 25° C. to 147° C. by ASTM method D3418-08, and wherein the dry thickness ratio of the extruded, non-voided compliant layer to the substrate is from 0.08:1 to 0.5:1.

This invention also provides an assembly comprising an imaging element of the present invention and an image donor element.

Moreover, a method of forming an image comprises imaging an imaging element of the present invention in thermal association with an image donor element, wherein the imaging element is a thermal dye transfer receiver element and the image donor element is a thermal dye transfer donor element.

The present invention provides a number of advantages for the thermal dye image transfer art. For example, the present invention allows a manufacturer to provide an imaging element in a single-pass operation if the image receiving layer and non-voided compliant layer are co-extruded. This can also eliminate expensive and time-consuming drying conditions if all layers in the element are extruded rather than provided by solvent- or aqueous-coating techniques. This invention also eliminates the need for an expensive antistatic layer that is often provided in such elements between the image receiving layer and the compliant layer. High quality images, with minimal image defects, are also provided by this invention from transferring an image to the image receiving element from a suitable donor element. These advantages are achieved by designing the non-voided compliant layer to have a particular heat of fusion and tensile modulus. If it is too high, the number of print defects increases and there is non-uniformity in the resulting dye image and there is low dye transfer efficiency. Moreover, if the tensile modulus is too low, jamming in the printers can increase, and if it is too high, the number of print defects increases. While some non-voided compliant layer formulations can have desirable properties if one or the other properties are not within the claim definitions, the combination of heat of fusion and tensile modulus provides the optimum of all desired properties. We also found, unexpectedly, that image density can be improved when the heat of fusion is in the lower regions of the defined heat of fusion (or enthalpy of fusion) range and the tensile modulus is in the higher region of the defined tensile modulus range.

DETAILED DESCRIPTION OF THE INVENTION

Definitions

Unless otherwise indicated, the terms "imaging element", "thermal dye receiver element", "image recording element", "thermal dye transfer receiver element", and "receiver element" refer to embodiments of the present invention.

The present invention relates to a multilayer element that is useful as an image recording element. This element includes two essential layers, an image receiving layer (IRL) and an extruded, non-voided compliant layer, both disposed on a suitable substrate (described below). The element can also include optional skin layers located immediately adjacent either side of the extruded, non-voided compliant layer, but there is no separate antistatic layer in the element between the extruded, non-voided compliant layer and the image receiving layer. The presence of an additional antistatic layer is undesirable because it adds to manufacturing costs and does not contribute to the advantages provided by this invention.

In one embodiment of the invention, the imaging element is a thermal dye transfer receiver element comprising a substrate and the extruded, non-voided compliant layer and the adjacent image receiving layer as the two essential layers. The thermal dye transfer receiver element can be used in an assembly of this invention with a thermal dye donor element to provide a dye image after thermal dye transfer. Multiple dye transfers to the same thermal dye transfer receiver element can provide a multi-color image.

The imaging element have the various layers described herein can be used in multiple techniques governing the thermal transfer of an image. Such techniques include but are not limited to, thermal dye transfer and thermal wax transfer. The present invention can also be used for electrophotographic printing. The imaging elements can be desired for reflection viewing if they have an opaque support, or desired for viewing by transmitted light if they have a transparent support.

The terms as used herein, "top", "upper", and "face" refer to the side or toward the side of the imaging element bearing the imaging layers, image, or image receiving layer.

The terms "bottom", "lower side", and "back" refer to the side or toward the side of the imaging element opposite from the side bearing the imaging layers, image, or image receiving layer.

The term "non-voided" as used to refer to the extruded compliant layer as being devoid of added solid or liquid matter that cause voids in the continuous layer phase, as well as devoid of voids containing a gas (such as polymeric vesicles).

"Image receiving layer" (IRL) can be a "dye receiving layer" (DRL).

The term "extruded" refers to layers applied using known extrusion techniques as opposed to being coated out of an aqueous or organic solvent coating formulation.

Extruded, Non-Voided Compliant Layer

The extruded, non-voided compliant layer used in the imaging element is provided from a blend of resins. Generally, this layer comprises multiple resins, at least some of which are elastomeric including but not limited to, thermoplastic elastomers like polyolefin blends, styrene/alkylene block copolymers (SBC) [such as styrene-ethylene/butylene-styrene (SEBS), styrene-ethylene/propylene-styrene (SEPS), styrene-butadiene-styrene (SBS), and styrene-isoprene-styrene (SIS)], polyether block polyamide (Pebax® type polymers), thermoplastic copolyester elastomer (COPE), thermoplastic urethanes (TPU), and polyolefins such as ethylene/propylene copolymers (for example, available as Vistamaxx™ polymers). Mixtures of the same or different types of elastomeric resins can be used. One or more elastomeric resins are present in the extruded layer in amount of at least 5 weight %, or from about 5 to about 30 weight %, or typically from about 10 to about 25 weight %.

The extruded, non-voided compliant layer can also include one or more amorphous or semi-crystalline polymers such as but not limited to, cyclic olefins, polystyrenes, maleated polyethylene (such as Dupont Bynel® grades, Arkema's Lotader® grades) that can be present in the extruded layer in an amount of at least 2 weight %, or from about 2 to about 25 weight %, or typically from about 5 to about 20 weight %.

The compliant layer can also include one or more "matrix" polymers that are not generally elastomeric. Such polymeric materials include but are not limited to, polyolefins such as polyethylene, polypropylene, and their copolymers, functionalized or grafted polyolefins, polystyrenes, polyamides like amorphous polyamide (like Selar), and polyesters. The amount of one or more matrix polymers in the extruded compliant layer is generally from about 35 to about 80 weight % or typically from about 40 to about 65 weight %.

Depending on the manufacturing process and thickness of the extruded compliant layer, the various types of resins are used individually or in mixtures or blends. For example, useful compliant layer resin blends include blends of ethylene/ethyl acrylate copolymers (EEA), ethylene/butyl acrylate copolymers (EBA), or ethylene/methyl acrylate copolymers (EMA) with SEBS like Kraton® G1657M; EEA, EBA, or EMA with SEBS and polypropylene; EEA, EBA, or EMA polymers with SEBS and polystyrene; EEA or EMA with SEBS and cyclic polyolefins (like Topas® resins); polypropylene with Kraton® polymers like FG1924, G1702, G1730M; polypropylene with ethylene propylene copolymers like Exxon Mobil's Vistamaxx™ grades; or blends of low density polyethylene (LDPE) with amorphous polyamide like Dupont's Selar and Kraton® FG grade of polymers and an additive compound such as maleated polyethylene (Dupont Bynel® grades, Arkema's Lotader® grades).

For example, some extruded, non-voided compliant layers include combinations of polymers such as from about 40 to about 65 weight % of a matrix polymer, from about 5 to about 30 weight % of an elastomeric polymer, and from about 2 to about 25 weight % of an amorphous or semi-crystalline polymer. The weight ratio of the three components can be varied and optimized based on the layer structure and the resins used.

The extruded compliant layer is "non-voided" as defined above.

Desirably, the extruded, non-voided compliant layer alone has a heat of fusion (enthalpy of fusion) equal to or greater than 0 and up to and including 45 joules/g of compliant layer, or from about 5 to about 45 joules/g (J/g) of compliant layer, as determined in the temperature range of from 25° C. to 147° C. by ASTM Method D3418-08 ("Standard Test Method for Transition Temperatures and Enthalpies of Fusion and Crystallization of Polymers by Differential Scanning calorimetry").

In addition, the extruded, non-voided compliant layer alone has a tensile modulus value of less than $5\times10^{10}$ dynes/cm$^2$, or from $7\times10^7$ to $5\times10^{10}$ dynes/cm$^2$, as determined using a Rheometric Solids Analyzer over a temperature range of 25° C. to 140° C. at a frequency of 1 Hz with a temperature change rate of 2° C./min. Each measurement described below was made at 25° C. in tensile using a 30×8×0.04 mm sample with an applied strain of 0.5% and a static force of 25 g.

In some embodiments, the extruded, non-voided compliant layer alone has a heat of fusion of from 0 to 30 joules/g (in the temperature range of 25° C. to 147° C.) and a tensile modulus value of from $1\times10^9$ to $5\times10^{10}$ dynes/cm$^2$ to provided optimum print density (specifically $D_{max}$) of the transferred image.

The resin compositions in the extruded, non-voided compliant layer are optimized for printer performance as well as enabling manufacture at high speeds using a high temperature process like extrusion coating. Extrusion requires that the resins have thermal stability, have the ability to be drawn down, have the appropriate shear viscosity and melt strength, and have good release from a chill roll. The shear viscosity range of the compliant layer resins and resin blends should be from about 1,000 poise to about 100,000 poise at 200° C. at a shear rate of 1 $s^{-1}$, or from about 2,000 poise to about 50,000 poise at 200° C. at a shear rate of 1 $s^{-1}$.

The dry thickness of the extruded, non-voided compliant layer is generally from about 15 to about 70 μm or typically from about 20 to about 45 μm. It can be advantageous in various embodiments that the dry thickness ratio of the extruded, non-voided compliant layer (on each side of the substrate) to the substrate is from about 0.08:1 to about 0.5:1, or from about 0.1:1 to about 0.33:1.

The extruded, non-voided compliant layer resin formulation can be applied using high temperature extrusion processes like cast extrusion or extrusion coating or hot melt at a temperature of from about 200 to about 285° C. at an extrusion speed of from about 0.0508 msec to about 5.08 msec. Useful extrusion speeds are high speeds due to productivity constraints and for economical reasons. In some instances, the resulting extruded, non-voided compliant layer can have a thickness greater than the final thickness obtained at slow speeds, but it is then stretched or made thinner by an orientation process that results in coating on a support at a higher speed. A less desirable variation of the orientation process is biaxial orientation of the extruded, non-voided compliant layer and laminating it to a support. The choice of manufacturing operation would be dependent upon the choice of compliant layer composition. For example, using polypropylene as the matrix material makes it possible to use either extrusion coating or an unaxial or biaxial orientation process.

As described in more detail below, the extruded, non-voided compliant layer can be formed by co-extrusion with one or more extruded skin layers immediately adjacent either or both sides of the extruded, non-voided compliant layer as described below.

An advantage of high temperature extrusion processes is that the roughness of the topmost surface of the element (image receiving layer) is determined by the chill roll or the casting wheel as well the choice of using an orientation process. This can be a roughness average $R_a$ of less than 0.8 μm and $R_z$ of less than 1.5 μm. On coating the top side of the support with the extruded compliant and image receiver layers (as described above), the imaging element roughness characteristics may or may not be different than the roughness of the top surface of the underlying substrate.

The extruded, non-voided compliant layer can also include additives such as opacifiers like titanium dioxide and calcium carbonate, colorants, dispersion aids like zinc stearate, chill roll release agents, antioxidants, UV stabilizers, and optical brighteners. However, such additives are not provided if they would cause voids within the extruded, non-voided compliant layer.

As noted below, the imaging element can include an extruded, non-voided compliant layer on both sides of the substrate, along with an image receiving layer on both sides of the substrate, to provide a dual-sided imaging element.

Skin Layer(s)

The imaging element can also include one or more skin layers, usually on the substrate side of the extruded, non-voided compliant layer. Such skin layers can be composed of polyolefins such as polyethylene, copolymers of ethylene, like ethylene/methyl acrylate (EMA) copolymers, ethylene/butyl acrylate (EBA) copolymers, ethylene/ethyl acrylate (EEA) copolymers, ethylene/methyl acrylate/maleic anhydride copolymers, or blends of these polymers. The acrylate content in the skin should be so adjusted that it does not block in roll form, or antiblock additives can be added to the layer formulation. Thermoplastic elastomers (as described above for the extruded, non-voided compliant layer) can be present in the skin layers if desired.

The thickness of the image side skin layer can be up to and including 10 μm, and typically up to and including 8 μm. The resin choice and the overall composition of the topmost surface of the substrate is optimized to obtain good adhesion to the extruded, non-voided compliant layer and to enable good chill roll or casting wheel release.

A skin layer on the substrate side of the extruded, non-voided compliant layer can be similarly composed and can have a thickness of up to and including 25 μm, and typically up to and including 15 μm.

The skin layers can be extruded individually at high temperatures of from about 200 to about 285° C. at speeds of from about 0.0508 msec to about 5.08 msec. Alternatively, they can be co-extruded (extruded simultaneously) with the extruded, non-voided compliant layer and cast on a chill roll, casting wheel, or cooling stack. A particularly useful configuration is the presence of a skin layer between the extruded, non-voided compliant layer and the substrate. Another useful configuration for this invention omits skin layers. When one or more skin layers are present, the total heat of fusion of skin and extruded, non-voided compliant layers together can satisfy the heat of fusion values described above for the extruded, non-voided compliant layer alone. It is also desirable that the co-extruded skin layer(s) and non-voided compliant layers together satisfy the modulus values described above for the extruded, non-voided compliant alone.

Image Receiving Layer

The image receiving layer used in the imaging element can be formed in any suitable manner, for example using solvent or aqueous coating techniques such as curtain coating, dip coating, solution coating, printing, or extrusion coating as is known in the art, for example in U.S. Pat. Nos. 5,411,931 (Kung), 5,266,551 (Bailey et al.), 6,096,685 (Pope et al.), 6,291,396 (Bodem et al.), 5,529,972 (Ramello et al.), and 7,485,402 (Arai et al.).

In most embodiments, the image receiving layer (such as a thermal dye image receiving layer) is extruded onto the extruded, non-voided compliant layer. For example, they can be co-extruded layers. The details of such image receiving layers are provided for example in U.S. Pat. No. 7,091,157 (Kung et al.) that is incorporated herein by reference. Further details about imaging receiving layers can be obtained from copending and commonly assigned U.S. Ser. Nos. 12/490,455 and 12/490,464 (noted above) that are also incorporated herein by reference. For example, such layers can comprise, for example, polycarbonate, polyurethane, polyester, vinyl polymer [such as a polyolefin, polyvinyl chloride, or poly (styrene-co-acrylonitrile)], poly(caprolactone), or mixtures or blends thereof.

The image receiver layer generally can be extruded at a thickness of at least 100 μm and typically from about 100 to about 800 μm, and then uniaxially stretched to less than 10 μm. The final thickness of the image receiving layer is generally from about 1 to about 10 μm, and typically from about 1 μm to about 5 μm with the optimal thickness being determined for the intended purpose. The coverage for example can be from about 0.5 to about 20 g/m$^2$ or typically from about 1 to about 10 g/m$^2$.

It can be sometimes desirable for the image receiving layer (such as a thermal dye image receiving layer) to also comprise other additives such as lubricants that can enable improved conveyance through a printer. An example of a lubricant is a polydimethylsiloxane-containing copolymer such as a polycarbonate random terpolymer of bisphenol A, diethylene glycol, and polydimethylsiloxane block unit and can be present in an amount of from 3% to 30% by weight of the image receiving layer. Other additives that can be present are plasticizers such as esters or polyesters formed from a mixture of 1,3-butylene glycol adipate and dioctyl sebacate. The plasticizer would typically be present in an amount of from about 3% to about 20% by total weight of the image receiving layer.

An image receiving layer can be present on one or both sides of the support, and can be single- or multi-layered. Thus, images can be formed on one or both sides of the receiving element.

The dry thickness ratio of the image receiving layer to the extruded, non-voided compliant layer (on each side of the element) is generally from about 0.04:1 to about 0.5:1 or typically from about 0.06:1 to about 0.3:1.

Preparation of Various Layers in Element

According to some embodiments of the invention, a skin layer can be formed on either or both surfaces of the extruded, non-voided compliant layer. The skin layer can be individually extruded onto the substrate described below by any of the extrusion methods like extrusion coating or cast extrusion or hot melt extrusion. In these methods, the polymer or resin blend is melted in the first step. In a second step, the melt is homogenized to reduce temperature excursions or adjusted and delivered to the die. In a third step, the skin layers are delivered onto a substrate or a modified substrate and rapidly quenched below their transition temperature (melting point or glass transition) so as to attain rigidity. For the skin layer closer to the substrate, the resin can be delivered onto the substrate while the skin layer closer to the image receiving layer can be delivered onto the extruded, non-voided compliant layer that has been extruded onto a substrate (this is known as modified substrate).

Instead of laying down the skin layer(s) individually that requires multiple stations or multiple operations, a useful method of laying down the skin layer(s) is simultaneously with the compliant layer. This is typically known as multi-layer co-extrusion. In this method, two or more polymers or resin formulations are extruded and joined together in a feedblock or die to form a single structure with multiple layers. Typically, two basic die types are used for co-extrusion: multi-manifold dies and feedblock with a single manifold die although hybrid versions exist that combine feedblocks with multi-manifold dies. In the case of a multi-manifold die, the die has individual manifolds that extend its full width. Each of the manifolds distributes the polymer layer uniformly. The combination of the layers (in this case skin(s) with the compliant layer) might occur inside the die before the final die land or outside the die. In the case of the feedblock method, the feedblock arranges the melt stream in the desired layer structure prior to the die inlet. A modular feedblock design along with the extruder flow rates enables the control of sequence and thickness distribution of the layers.

Overall in a first step for creating the skin layer(s), the polymer or resin blend composition is melted and delivered to the co-extrusion configuration. Similarly for the extruded, non-voided compliant layer, the resin blend composition is melted and delivered to the co-extrusion configuration. To enable good spreading and layer uniformity, the skin layer viscosity characteristics should not be more than 10 times or 1:10, or not more than 3 times or less than 1:3 difference in viscosity from that of the melt that forms the compliant layer. This promotes efficient and high quality co-extrusion and avoids nonuniform layers. Layer uniformity can be adjusted by varying melt temperature. To enable good interlayer adhesion, material composition can be optimized, layer thickness can be varied, and also the melt temperature of the streams adjusted in the co-extrusion configuration.

In a third step of creating a coextruded structure of skin layer(s) with a compliant layer, the co-extruded layers or laminate can be stretched or oriented to reduce the thickness. In a fourth step, the extruded and stretched laminate is applied to the support described below while simultaneously reducing the temperature within the range below the melting temperature ($T_m$) or glass transition temperature ($T_g$) of the skin layer(s), for example, by quenching between two nip rollers that can have the same or different finish such as matte, rough glossy, or mirror finish.

In addition, the skin layers can be extruded separately (as noted above), or co-extruded with one or more of the other layers.

When the image receiving layer is solvent or aqueous coated it can be crosslinked during the coating or drying operation or crosslinked later by an external means like UV irradiation.

Element Structure and Supports

The particular structure of an imaging element (for example, a thermal dye transfer receiver element) of the present invention can vary, but it is generally a multilayer structure consisting essentially of, under the image receiving layer, in order, an extruded, non-voided compliant layer, an optional skin layer, and a substrate (defined as all layers below the extruded compliant layer) that comprises a base support, such as a raw paper stock comprising cellulose fibers, a synthetic paper comprising synthetic polymer fibers, or a resin coated paper. But other base supports such as fabrics and polymer sheets can be used. The base support can be any support typically used in imaging applications. Any of the imaging elements of this invention could further be laminated to a substrate or support to increase the utility of the imaging element.

The resins used on the bottom or wire side (backside) of the paper base are thermoplastics like polyolefins such as polyethylene, polypropylene, copolymers of these resins, or blends of these resins. The thickness of the resin layer on the bottom side of the raw base can range from about 5 μm to about 75 μm and typically from about 10 μm to about 40 μm. The thickness and resin composition of the resin layer can be adjusted to provide desired curl characteristics. The surface roughness of this resin layer can be adjusted to provide desired conveyance properties in imaging printers.

The base support can be transparent or opaque, reflective or non-reflective. Opaque supports include plain paper, coated paper, resin-coated paper such as polyolefin-coated paper, synthetic paper, low density foam core based support, and low density foam core based paper, photographic paper support, melt-extrusion-coated paper, and polyolefin-laminated paper.

The papers include a broad range of papers, from high end papers, such as photographic paper to low end papers, such as newsprint. In one embodiment, Ektacolor® paper made by Eastman Kodak Co. as described in U.S. Pat. Nos. 5,288,690 (Warner et al.) and 5,250,496 (Warner et al.), both incorporated herein by reference, can be employed. The paper can be made on a standard continuous fourdrinier wire machine or on other modern paper formers. Any pulp known in the art to provide paper can be used. Bleached hardwood chemical kraft pulp is useful as it provides brightness, a smooth starting surface, and good formation while maintaining strength. Papers useful in this invention are generally of caliper of from about 50 μm to about 230 μm and typically from about 100 μm to about 190 μm, because then the overall imaged element thickness is in the range desired by customers and for processing in existing equipment. They can be "smooth" so as to not interfere with the viewing of images. Chemical additives to impart hydrophobicity (sizing), wet strength, and dry strength can be used as needed. Inorganic filler materials such as $TiO_2$, talc, mica, $BaSO_4$ and $CaCO_3$ clays can be used to enhance optical properties and reduce cost as needed. Dyes, biocides, and processing chemicals can also be used as needed. The paper can also be subject to smoothing operations such as dry or wet calendering, as well as to coating through an in-line or an off-line paper coater.

A particularly useful support is a paper base that is coated with a resin on either side. Biaxially oriented base supports include a paper base and a biaxially oriented polyolefin sheet, typically polypropylene, laminated to one or both sides of the paper base. Commercially available oriented and non-oriented polymer films, such as opaque biaxially oriented polypropylene or polyester, can also be used. Such supports can contain pigments, air voids or foam voids to enhance their opacity. The base support can also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 that is incorporated herein by reference. Microvoided composite biaxially oriented sheets can be utilized and are conveniently manufactured by coextrusion of the core and surface layers, followed by biaxial orientation, whereby voids are formed around void-initiating material contained in the core layer. Such composite sheets are disclosed in, for example, U.S. Pat. Nos. 4,377,616 (Ashcraft et al.), 4,758,462 (Park et al.), and 4,632,869 (Park et al.), the disclosures of which are incorporated by reference.

Unlike the extruded, non-voided compliant layer, the substrate can be voided, which means voids formed from added solid and liquid matter, or "voids" containing gas. The void-initiating particles, which remain in the finished packaging sheet core, should be from about 0.1 to about 10 μm in diameter and typically round in shape to produce voids of the desired shape and size. The size of the void is also dependent on the degree of orientation in the machine and transverse directions. Ideally, the void would assume a shape that is defined by two opposed, and edge contacting, concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids generally tend to be closed cells, and thus there is virtually no path open from one side of the voided-core to the other side through which gas or liquid can traverse.

Biaxially oriented sheets, while described as having at least one layer, can also be provided with additional layers that can serve to change the properties of the biaxially oriented sheet. Such layers might contain tints, antistatic or conductive materials, or slip agents to produce sheets of unique properties. Biaxially oriented sheets can be formed with surface layers, referred to herein as skin layers, which would provide an improved adhesion, or look to the support and photographic element. The biaxially oriented extrusion can be carried out with as many as 10 layers if desired to achieve some particular desired property. The biaxially oriented sheet can be made with layers of the same polymeric material, or it can be made with layers of different polymeric composition. For compatibility, an auxiliary layer can be used to promote adhesion of multiple layers.

Transparent supports include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The substrate used in the invention can have a thickness of from about 50 to about 500 μm or typically from about 75 to about 350 μm. Antioxidants, brightening agents, antistatic or conductive agents, plasticizers and other known additives can be incorporated into the substrate, if desired. In one embodiment, the element has an L*UVO (UV out) of greater than 80 and a b*UVO of from 0 to −6.0. L*, a* and b* are CIE parameters (see, for example, Appendix A in Digital Color Management by Giorgianni and Madden, published by Addison, Wesley, Longman Inc., 1997) that can be measured using a Hunter Spectrophotometer using the D65 procedure. "UV out" (UVO) refers to use of UV filter during characterization such that there is no effect of UV light excitation of the sample.

Useful antistatic agents in the substrate (such as a raw paper stock) include but are not limited to, metal particles, metal oxides, inorganic oxides, metal antimonates, inorganic non-oxides, and electronically conductive polymers, examples of which are described in copending and commonly assigned U.S. Ser. No. 12/581,921 (noted above) that is incorporated herein by reference. Particularly useful are inorganic or organic electrolytes. Alkali metal and alkaline earth salts (or electrolytes) such as sodium chloride, potassium chloride, and calcium chloride, and electrolytes comprising polyacids are useful. For example, alkali metal salts include lithium, sodium, or potassium polyacids such as salts of polyacrylic acid, poly(methacrylic acid), maleic acid, itaconic acid, crotonic acid, poly(sulfonic acid), or mixed polymers of these compounds. Alternatively, the raw base support can contain various clays such as smectite clays that include exchangeable ions that impart conductivity to the raw base support. Polymerized alkylene oxides, such as combinations of polymerized alkylene oxide and alkali metal salts as described in U.S. Pat. Nos. 4,542,095 (Steklenski et al.) and 5,683,862 (Majumdar et al.) are useful as electrolytes.

The antistatic agents can be present in the cellulose raw base support in an amount of up to 0.5 weight % or typically from 0.01 to 0.4 weight % based on the total substrate dry weight.

In another embodiment, the base support comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers; their copolymers or their blends thereof; or other polymeric systems like polyurethanes and polyisocyanurates. These materials can or can not have been expanded either through stretching resulting in voids or through the use of a blowing agent to consist of two phases, a solid polymer matrix, and a gaseous phase. Other solid phases can be present in the form of fillers that are of organic (polymeric, fibrous) or inorganic (glass, ceramic, metal) origin. The fillers can be used for physical, optical (lightness, whiteness, and opacity), chemical, or processing property enhancements of the core.

In still another embodiment, the support comprises a synthetic paper that can be cellulose-free, having a foamed polymer core or a foamed polymer core that has adhered thereto at least one flange layer. The polymers described for use in a polymer core can also be employed in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure; the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. The foamed polymer core can comprise a polymer expanded through the use of a blowing agent.

In a many embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

One embodiment of the invention is a thermal dye transfer image receiving element for thermal dye transfer having a substrate and consisting essentially of on one side thereof an extruded, non-voided compliant layer, and an extruded thermal dye image receiving layer, and optionally one or more skin layers on either or both sides of the extruded, non-voided compliant layer.

In some embodiments, the imaging elements (such as the thermal dye transfer receiver elements) are "dual-sided", meaning that they have an image receiving layer (such as a thermal dye image receiving layer) on both sides of the substrate. In such embodiments, there can be an extruded, non-voided compliant layer and optional skin layers on both sides of the substrate. Thus, some embodiments can have the same arrangement of layers on each side of the substrate. These dual-sided imaging elements are therefore designed to "receive" and provide the same or different image on opposite sides of the substrate.

Dye Donors Elements

Ink or thermal dye-donor elements that can be used with the imaging element of this invention generally comprise a support having thereon an ink or dye containing layer.

Any ink or dye can be used in the thermal ink or dye-donor provided that it is transferable to the thermal ink or image receiving or recording layer by the action of heat. Ink or dye donor elements are described, for example, in U.S. Pat. Nos. 4,916,112 (Henzel et al.), 4,927,803 (Bailey et al.), and 5,023,228 (Henzel) that are all incorporated herein by reference. As noted above, ink or dye-donor elements can be used to form an ink or dye transfer image. Such a process comprises image-wise-heating an ink or dye-donor element and transferring an ink or dye image to an ink or dye image receiving or recording element as described above to form the ink or dye transfer image. In the thermal ink or dye transfer method of printing, an ink or dye donor element can be employed that comprises a poly(ethylene terephthalate) support coated with sequential repeating areas of cyan, magenta, or yellow ink or dye, and the ink or dye transfer steps can be sequentially performed for each color to obtain a multi-color ink or dye transfer image. The support can include a black ink. The support can also include a clear protective layer that can be transferred onto the transferred dye images. When the process is performed using only a single color, then a monochrome ink or dye transfer image can be obtained.

Dye-donor elements that can be used with the imaging element conventionally comprise a support having thereon a dye containing layer. Any dye can be used in the dye layer of the dye-donor element provided it is transferable to the dye-receiving layer by the action of heat. Especially good results have been obtained with diffusible dyes, such as the magenta dyes described in U.S. Pat. No. 7,160,664 (Goswami et al.) that is incorporated herein by reference.

The dye-donor layer can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the dye layer can include a magenta dye combination and further comprise a yellow dye-donor patch comprising at least one bis-pyrazolone-methine dye and at least one other pyrazolone-methine dye, and a cyan dye-donor patch comprising at least one indoaniline cyan dye.

Any dye transferable by heat can be used in the dye-donor layer of the dye-donor element. The dye can be selected by taking into consideration hue, lightfastness, and solubility of the dye in the dye donor layer binder and the dye image receiving layer binder.

Further examples of useful dyes can be found in U.S. Pat. Nos. 4,541,830 (Hotta et al.); 4,698,651 (Moore et al.); 4,695,287 (Evans et al.); 4,701,439 (Evans et al.); 4,757,046 (Byers et al.); 4,743,582 (Evans et al.); 4,769,360 (Evans et al.); 4,753,922 (Byers et al.); 4,910,187 (Sato et al.); 5,026,677 (Vanmaele); 5,101,035 (Bach et al.); 5,142,089 (Vanmaele); 5,374,601 (Takiguchi et al.); 5,476,943 (Komamura et al.); 5,532,202 (Yoshida); 5,804,531 (Evans et al.); 6,265,345 (Yoshida et al.); and 7,501,382 (Foster et al.), and U.S. Patent Application Publications 2003/0181331 (Foster et al.) and 2008/0254383 (Soejima et al.), the disclosures of which are hereby incorporated by reference.

The dyes can be employed singly or in combination to obtain a monochrome dye-donor layer or a black dye-donor layer. The dyes can be used in an amount of from about 0.05 $g/m^2$ to about 1 $g/m^2$ of coverage. According to various embodiments, the dyes can be hydrophobic.

Imaging and Assemblies

As noted above, dye-donor elements and imaging elements can be used to form a dye transfer image. Such a process comprises imagewise-heating a thermal dye donor element and transferring a dye image to an imaging element as described above to form the dye transfer image.

A thermal dye donor element can be employed which comprises a poly(ethylene terephthalate) support coated with sequential repeating areas of cyan, magenta and yellow dye, and the dye transfer steps are sequentially performed for each color to obtain a three-color dye transfer image. The dye donor element can also contain a colorless area that can be transferred to the imaging element to provide a protective overcoat.

Thermal printing heads which can be used to transfer ink or dye from ink or dye-donor elements to an imaging element can be available commercially. There can be employed, for example, a Fujitsu Thermal Head (FTP-040 MCS001), a TDK Thermal Head F415 HH7-1089, or a Rohm Thermal Head KE 2008-F3. Alternatively, other known sources of energy for thermal ink or dye transfer can be used, such as lasers as described in, for example, GB Publication 2,083,726A that is incorporated herein by reference.

In another embodiment, the imaging element can be an electrophotographic imaging element. The electrographic and electrophotographic processes and their individual steps have been well described in the prior art, for example U.S. Pat. No. 2,297,691 (Carlson). The processes incorporate the basic steps of creating an electrostatic image, developing that image with charged, colored particles (toner), optionally transferring the resulting developed image to a secondary substrate, and fixing the image to the substrate. There are numerous variations in these processes and basic steps such as the use of liquid toners in place of dry toners is simply one of those variations. Other electrophotographic process details are provided in U.S. Pat. Nos. 7,632,562 (Nair et al.) and 7,678,445 (Dontula et al.) and U.S. Published Patent Application 2006/0115664 (Dontula et al.), all incorporated by reference.

For example, the electrophotographic processes can be used to image a thermal dye transfer element that consists essentially of a substrate comprising a raw paper base, and having on the same surface, only the following layers, in order:

a) an extruded, non-voided compliant layer comprising:

from about 35 to about 80 weight % of a matrix polymer derived at least in part from a polyolefin, from about 10 to about 25 weight % of at least one elastomeric polymer that is a thermoplastic polyolefin blend, styrene/alkylene block copolymer, polyether block polyamide, copolyester elastomer, ethylene/propylene copolymer, or thermoplastic urethane, and from about 5 to about 20 weight % of at least one amorphous or semi-crystalline polymer that is a polystyrene, polypropylene, or cyclic olefin copolymers, b) a thermal dye image receiving layer comprising a polyester, polycarbonate, vinyl polymer, or a combination thereof, and c) optionally a co-extruded skin layer immediately adjacent on either or both sides of the extruded, non-voided compliant layer, wherein the extruded thermoplastic resin compliant layer has a heat of fusion of from 5 to 45 joules/g of compliant layer as determined in the temperature range of from 25° C. to 147° C. by ASTM method D3418-08, and wherein the dry thickness ratio of the extruded, non-voided compliant layer to the substrate is from 0.08:1 to 0.5:1.

The first basic step, creation of an electrostatic image, can be accomplished by a variety of methods. The electrophotographic process of copiers uses imagewise photodischarge, through analog or digital exposure, of a uniformly charged photoconductor. The photoconductor can be a single use system, or it can be rechargeable and reimageable, like those based on selenium or organic photoreceptors.

In an alternate electrographic process, electrostatic images are created ionographically. The latent image is created on dielectric (charge holding) medium, either paper or film. Voltage is applied to selected metal styli or writing nibs from an array of styli spaced across the width of the medium, causing a dielectric breakdown of the air between the selected styli and the medium. Ions are created, which form the latent image on the medium.

Electrostatic images, however generated, are developed with oppositely charged toner particles. For development with liquid toners, the liquid developer is brought into direct contact with the electrostatic image. Usually a flowing liquid is employed to ensure that sufficient toner particles are available for development. The field created by the electrostatic image causes the charged particles, suspended in a nonconductive liquid, to move by electrophoresis. The charge of the latent electrostatic image is thus neutralized by the oppositely charged particles. The theory and physics of electrophoretic development with liquid toners are well described in many books and publications.

If a reimageable photoreceptor or an electrographic master is used, the toned image is transferred to an electrophotographic image receiving element. The receiving element is charged electrostatically, with the polarity chosen to cause the toner particles to transfer to the receiving element. Finally, the toned image is fixed to the receiving element. For self-fixing toners, residual liquid is removed from the receiving element by air drying or heating. Upon evaporation of the solvent, these toners form a film bonded to the image receiver element. For heat-fusible toners, thermoplastic polymers are used as part of the particle. Heating both removes residual liquid and fixes the toner to receiving element.

In another embodiment of this invention, the imaging element can be used to receive a wax-based ink from an ink jet printhead using what is known as a "phase change ink" that is transferred as described for example in U.S. Pat. Nos. 7,381,254 (Wu et al.), 7,541,406 (Banning et al.), and 7,501,015 (Odell et al.) that are incorporated herein by reference.

A thermal transfer assemblage can comprise (a) an ink or dye-donor element, and (b) an ink or dye image receiver, or imaging, element of this invention, the imaging element being in a superposed relationship with the ink or dye donor element so that the ink or dye layer of the donor element can be in contact with the ink or thermal dye image receiving layer. Imaging can be obtained with this assembly using known processes.

When a three-color image is to be obtained, the above assemblage can be formed on three different occasions during the time when heat can be applied by the thermal printing head. After the first dye is transferred, the elements can be peeled apart. A second dye donor element (or another area of the donor element with a different dye area) can be then brought in register with the thermal dye receiving layer and the process repeated. The third color can be obtained in the same manner.

The present invention provides at least the following embodiments and combinations thereof, but other combinations of features are considered to be within the present invention as a skilled artisan would appreciate from the teaching of this disclosure:

1. An imaging element consisting essentially of a substrate and on the same surface, in order:

an extruded, non-voided compliant layer, an image receiving layer, and optionally a skin layer between the extruded, non-voided compliant layer and the image receiving layer, wherein the extruded, non-voided compliant layer has a heat of fusion of equal to or greater than 0 and up to and including 45 joules/g of compliant layer as determined in a temperature range of from 25° C. to 147° C. by ASTM method D3418-08, and a tensile modulus value of from $7\times10^{7}$ to $5\times10^{10}$ dynes/cm$^2$.

2. The imaging element of embodiment 1 wherein the extruded, non-voided compliant layer has a heat of fusion of from about 5 to about 45 joules/g of compliant layer.

3. The imaging element of embodiment 1 or 2 wherein the extruded, non-voided compliant layer has a heat of fusion of from 0 to 30 joules/g of compliant layer and a tensile modulus value of from $1\times10^{9}$ to $5\times10^{10}$ dynes/cm$^2$.

4. The imaging element of any of embodiments 1 to 3 wherein the extruded, non-voided compliant layer comprises at least one elastomeric resin in an amount of at least 5 weight %, and at least one amorphous or semi-crystalline polymer in an amount of at least 2 weight %.

5. The imaging element of any of embodiments 1 to 4 wherein the extruded, non-voided compliant layer comprises from about 35 to about 80 weight % of a matrix polymer, and comprises from about 5 to about 30 weight % of the elastomeric polymer and from about 2 to about 25 weight % of the amorphous or semi-crystalline polymer.

6. The imaging element of any of embodiments 1 to 5 wherein the elastomeric resin is a thermoplastic polyolefin blend, styrene/alkylene block copolymer, polyether block polyamide, thermoplastic copolyester elastomer, polyolefin, or thermoplastic urethane, or a mixture thereof.

7. The imaging element of any of embodiments 1 to 6 wherein the dry thickness ratio of the extruded, non-voided compliant layer to the substrate is from about 0.08:1 to about 0.5:1.

8. The imaging element of any of embodiments 1 to 7 further having an extruded skin layer immediately adjacent each side of the extruded, non-voided compliant layer.

9. The imaging element of embodiment 8 wherein the extruded skin layer(s) and extruded, non-voided compliant layer are co-extruded layers.

10. The imaging element of any of embodiments 1 to 9 wherein the extruded, non-voided compliant layer has a dry thickness of from about 15 to about 70 μm.

11. The imaging element of any of embodiments 1 to 10 wherein the substrate comprises cellulose fibers.

12. The imaging element of any of embodiments 1 to 11 wherein the substrate comprises raw paper stock comprising an antistatic agent.

13. The imaging element of any of embodiments 1 to 12 wherein the image receiving layer comprises a polyester, a polycarbonate, a vinyl polymer, or a combination thereof.

14. The imaging element of any of embodiments 1 to 13 wherein the image receiving layer and the extruded, non-voided compliant layers are co-extruded layers.

15. The imaging element of any of embodiments 1 to 14 that is dual-sided with an image receiving layer, an extruded, non-voided compliant layer, and optional skin layer, on each side of the substrate.

16. The imaging element of any of embodiments 1 to 15 wherein the image receiving layer is a thermal dye transfer image receiving layer and the imaging element is a thermal dye transfer receiver element.

17. A thermal dye transfer element consisting essentially of a substrate comprising a raw paper base, and having the same surface, only the following layers, in order:

a) an extruded, non-voided compliant layer comprising:

from about 35 to about 80 weight % of a matrix polymer derived at least in part from a polyolefin, from about 10 to about 25 weight % of at least one elastomeric polymer that is a thermoplastic polyolefin blend, styrene/alkylene block copolymer, polyether block polyamide, copolyester elastomer, ethylene/propylene copolymer, or thermoplastic urethane, and from about 5 to about 20 weight % of at least one amorphous or semi-crystalline polymer that is a polystyrene, polypropylene, or cyclic olefin copolymers, b) a thermal dye image receiving layer comprising a polyester, polycarbonate, vinyl polymer, or a combination thereof, and c) a co-extruded skin layer immediately adjacent on either or both sides of the extruded, non-voided compliant layer, wherein the extruded thermoplastic resin compliant layer has a heat of fusion of from 10 to 45 joules/g of compliant layer as determined in a temperature range of from 25° C. to 147° C. by ASTM method D3418-08, and wherein the dry thickness ratio of the extruded, non-voided compliant layer to the substrate is from 0.08:1 to 0.5:1.

18. An assembly comprising the imaging element of any of embodiments 1 to 17 and an image donor element.

19. The assembly of embodiment 18 wherein the imaging element is a thermal dye transfer receiver element and the image donor element is a thermal dye donor element.

20. A method of forming an image comprising imaging the imaging element of any of embodiments 1 to 19 in thermal association with an image donor element, wherein the imaging element is a thermal dye transfer receiver element and the image donor element is a thermal dye transfer donor element.

The following Examples are provided to illustrate the present invention and are not meant to be limiting in any manner.

EXAMPLES

A dye receiving layer formulation was prepared and used in the imaging elements described below. Polyester E-2 (branched polyester prepared as described in U.S. Pat. No. 6,897,183, Col. 15, lines 3-32) that is incorporated herein by reference, was dried in a desiccant dryer at 43° C. for 24 hours. Lexan® 151 polycarbonate (General Electric), Lexan® EXRL1414TNA8A005T polycarbonate (General Electric), and MB50-315 silicone (Dow Chemical Co.) were mixed together at a 0.819:1:0.3 weight ratio and dried at 120° C. for 2-4 hours. Dioctyl sebacate (DOS) was preheated to 83° C. and phosphorous acid was mixed in to make a phosphorous acid concentration of 0.4 weight %, and the mixture was maintained at 83° C. and mixed for 1 hour under nitrogen.

These components were then used in a compounding operation using a Leistritz ZSK 27 extruder with a 30:1 length to diameter ratio. The mixture of polycarbonates and silicone were introduced into the compounder first and melted. Then the dioctyl sebacate/phosphorous acid solution was added, and finally the branched polyester was added. The final formulation contained 73.46 weight % of branched polyester, 8.9 weight % of Lexan® 151 polycarbonate, 10 weight % of Lexan® EXRL1414TNA8A005T, 3 weight % of MB50-315 silicone, 5.33 weight % of DOS, and 0.02 weight % of phosphorous acid. A vacuum was applied with slightly negative pressure and the melt temperature was 240° C. The melted formulation was then extruded through a strand die, cooled in 32° C. water, and pelletized. The pellets were then aged for about 2 weeks and predried before their use in extrusion in desiccated air at 38° C. for 24 hours.

The following extruded compliant layers were prepared for the various imaging elements using the following components:

"811A LDPE" represents low density polyethylene that can be obtained from Westlake Chemical.

"Amplify™ EA102" and "Amplify™ EA103" are poly (ethylene-co-ethyl acetates) that can be obtained from Dow Chemical.

"P9HM015" is primarily a polypropylene that can be obtained from Flint Hills Corporation.

"EA3710" (or MC3700) represents a polystyrene that can be obtained from Americas Styrenics.

Vistamaxx™ 6202 is a poly(ethylene-co-propylene) that was obtained from Exxon Mobil.

Kraton® G1657 is a thermoplastic elastomer that was obtained from Kraton Corporation.

"Togas® 5013X-14S" is a cyclic polyolefin copolymer that was obtained from Topas Corporation.

The $TiO_2$ used was rutile titanium dioxide.

A "tie" layer is another name for an extruded subbing layer (or slip layer) as described below. For the examples, the tie layer used was composed of poly(ethylene-co-ethyl acrylate), Amplify™ EA103, and has 19.5% ethyl acrylate and a melt flow rate of 21 (190° C., 2.16 Kg, ASTM D1238). This layer was used to adhere the dye receiving layer formulation to the substrate.

Comparative Example 1

A photographic cellulosic raw base having a 170 μm thickness and a wire side (backside) coating of unpigmented polyethylene at a coverage of 14.65 g/m$^2$ was used as a substrate. On the imaging side, a monolayer structure was created by extrusion coating a compliant resin layer against a matte chill roll. This compliant resin layer was composed of 89.75 weight % of 811A LDPE, 10 weight % of $TiO_2$, 0.25 weight % of zinc stearate, and 0.1 weight % of Irganox® 1076 antioxidant that was created by compounding in a Leistritz ZSK27 compounder. The total compliant layer dry coverage was 24.4 g/m$^2$. The substrate was coated on the imaging side with the extruded subbing (tie) layer and the dye receiving layer formulation. The dry thickness ratio of the dye receiving layer to tie layer was 2:1.

Comparative Example 2

A wire side resin-coated photographic raw base as described in Comparative Example 1 was extrusion coated on the imaging side against a matte chill roll with a compliant layer formulation composed of 89.75 weight % of Amplify™ EA103, 10 weight % of $TiO_2$, 0.25 weight % of zinc stearate, and 0.1 weight % of Irganox® 1076 antioxidant for a total coverage of 24.4 g/m$^2$. The compliant layer formulation was created by compounding in the Leistritz ZSK27 compounder. The created substrate was coated on the imaging side with an extruded subbing (tie) layer and dye receiving layer to provide a layer ratio of the dye receiving layer to tie layer of 2:1.

Comparative Example 3

A wire side resin-coated photographic raw base as described in Comparative Example 1 was extrusion coated on the imaging side against a matte chill roll with a compliant resin layer composed of 89.75 weight % of P9H8M015 polypropylene, 10 weight % of $TiO_2$, 0.25 weight % of zinc stearate, and 0.1 weight % of Irganox® 1076 antioxidant to provide a coverage of 24.4 g/m$^2$. This compliant resin layer was created by compounding in the Leistritz ZSK27 compounder. The created substrate was coated on the imaging side with an extruded subbing (tie) layer and dye receiving layer to provide a layer ratio of the dye receiving layer to tie layer of 2:1.

Comparative Example 4

A wire-side resin-coated photographic raw base as described in Comparative Example 1 was extrusion coated against a matte chill roll with a compliant resin layer composed of 53.8 weight % P9H8M015 polypropylene, 35.9 weight % of Vistamaxx™ 6202 copolymer, 10 weight % of $TiO_2$, 0.25 weight % of zinc stearate, and 0.1 weight % of Irganox® 1076 antioxidant to provide a coverage of 24.4 g/m$^2$. This compliant resin layer was created by compounding in the Leistritz ZSK27 compounder. The created substrate was coated on the imaging side with an extruded slip (tie) layer and dye receiving layer to provide a layer ratio of the dye receiving layer to tie layer of 2:1.

Invention Example 1

An imaging element of this invention was prepared as follows. A wire-side resin-coated photographic raw base as described in Comparative Example 1 was extrusion coated against a matte chill roll with a compliant resin layer composed of 53.6 weight % of Amplify® EA103 resin, 25.05 weight % Kraton® G1657 resin, 11 weight % of P9H8M015 polypropylene, 10 weight % of $TiO_2$, 0.25 weight % of zinc stearate, and 0.1 weight % of Irganox® 1076 antioxidant to provide a coverage was 24.4 g/m$^2$. This compliant resin layer was created by compounding in the Leistritz ZSK27 compounder. The created substrate was coated on the imaging side with an extruded subbing (tie) layer and dye receiving layer to provide a layer ratio of the dye receiving layer to tie layer of 2:1.

Invention Example 2

An imaging element of this invention was prepared like that of Invention Example 1 except that the compliant layer was composed of 53.6 weight % of Amplify® EA102 resin, 25.05 weight % of Kraton® G1657 resin, 11 weight % P9H8M015 polypropylene, 10 weight % $TiO_2$, 0.25 weight % of zinc stearate, and 0.1 weight % of Irganox® 1076 antioxidant to provide a coverage of 24.4 g/m$^2$. The created substrate was coated on the imaging side with an extruded subbing (tie) layer and dye receiving layer to provide a layer ratio of the dye receiving layer to the tie layer of 2:1.

Invention Example 3

An imaging element of this invention was prepared like that of Invention Example 1 except that the compliant layer was composed of 53.6 weight % of Amplify® EA102 resin, 25.05 weight % of Kraton® G1657 resin, 11 weight % EA3710 (a polystyrene), 10 weight % $TiO_2$, 0.25 weight % of zinc stearate, and 0.1 weight % of Irganox® 1076 antioxidant to provide a coverage of 24.4 g/m$^2$. The created substrate was coated on the imaging side with an extruded subbing (tie) layer and dye receiving layer to provide a layer ratio of the dye receiving layer to the tie layer of 2:1.

Invention Example 4

An imaging element of this invention was prepared like that of Invention Example 1 except that the compliant layer was co-extruded with the dye receiving layer (with no intermediate skin layer or extruded subbing layer) against a glossy chill roll. The dye receiving layer was in contact with chill roll and had a coverage of 2.2 g/m$^2$. The compliant layer was composed of 53.6 weight % of Amplify® EA102 resin, 25.05 weight % of Kraton® G1657 resin, 11 weight % of PS, 10 weight % of $TiO_2$, 0.25 weight % of zinc stearate, and 0.1 weight % of Irganox® 1076 antioxidant to provide a coverage of 24.4 g/m$^2$.

Invention Example 5

An imaging element of this invention was prepared like that of Invention Example 1 except that the compliant layer on the imaging side was created by co-extrusion with the dye receiving layer against a glossy chill roll. There was no intermediate subbing (tie) layer. The dye receiving layer had a coverage of 2.2 g/m$^2$. The compliant layer was composed of 50.65 weight % of Amplify® EA102 resin, 23.5 weight % Kraton® G1657 resin, 10.5 weight % of MC3700 (a polystyrene), 5 weight % of Topas® 5013X-14S resin, 10 weight % of $TiO_2$, 0.25 weight % of zinc stearate, and 0.1 weight % Irganox® 1076 antioxidant to provide a coverage of 24.4 g/m$^2$.

Invention Example 6

An imaging element of this invention was prepared like that of Invention Example 1 except that the compliant layer on the imaging side was created by co-extrusion with the dye receiving layer against a glossy chill roll. There was no intermediate extruded subbing (tie) layer. The dye receiving layer was extruded at a coverage was 6.59 g/m$^2$. The compliant layer was composed of 53.6 weight % of Amplify® EA102 resin, 25.05 weight % of Kraton® G1657 resin, 11 weight % of PP, 10 weight % $TiO_2$, 0.25 weight % of zinc stearate, and 0.1 weight % of Irganox® 1076 antioxidant to provide a coverage of 24.4 g/m$^2$.

Invention Example 7

An imaging element of this invention was prepared as described in Invention Example 1 except that the imaging side had a coextruded compliant layer and dye receiving layer against a glossy chill roll. The dye receiving layer was in contact with the chill roll and extruded at a coverage was 6.59 g/m$^2$. The compliant layer was composed of 53.6 weight % Amplify® EA102 resin, 25.05 weight % Kraton® G1657 resin, 11 weight % of PS, 10 weight % of $TiO_2$, 0.25 weight % of zinc stearate, and 0.1 weight % of Irganox® 1076 antioxidant to provide a coverage was 24.4 g/m$^2$.

Invention Example 8

An imaging element was prepared as described in Invention Example 8 except that the dye receiving layer coverage was 2.2 g/m$^2$ and the compliant layer was composed of 53.6 weight % of Amplify® EA102 resin, 25.05 weight % of Kraton® G1657 resin, 11 weight % of P9H8M015 polypropylene, Topas® resin, 10 weight % of $TiO_2$, 0.25 weight % of zinc stearate, and 0.1 weight % of Irganox® 1076 antioxidant to provide a coverage of 24.4 g/m$^2$.

Invention Example 9

For this example, a paper core was laminated on both the image receiving side and the backside side with ExxonMobil's Bicor 70 MLT non-microvoided polypropylene film (18 μm thick with a specific gravity of 0.9) as a compliant layer. This film is a multilayered film and has multiple resin components. This results in a film that has on one side a matte finish and the other side is smooth and has been treated. The lamination on imaging side was carried out in a way that the treated side was farther away from the raw base substrate. The created substrate was coated on the imaging side with the extruded tie layer and dye receiving layer to provide a layer thickness ratio of 1:2. The compliant layer (the multilayer film) had a heat of fusion of 11.89 J/g and a tensile modulus of $8.06\times10^9$ dynes/cm$^2$.

TABLE I

| Imaging Element | Support Coating on Imaging Side | Total Heat of Fusion * (J/g) | Tensile Modulus * (dynes/cm$^2$) 25° C. | Image Defects |
|---|---|---|---|---|
| Comparative Example 1 | Low density polyethylene | 93.17 | $8.08 \times 10^8$ | Poor print quality; many print defects ("white" spots **) |
| Comparative Example 2 | Compliant Layer (EA 103 + $TiO_2$) | 66.7 | $1.94 \times 10^8$ | Some ("white" spots; less than Comparative Example 1 |
| Comparative Example 3 | Compliant layer (P9H8M015 + $TiO_2$) | 16.25 | $3.28 \times 10^9$ | Print defects in form of small blisters or bubbles |
| Invention Example 1 | Compliant layer (EA103, Kraton ® G1657, PP, & $TiO_2$) | 36.41 | $2.92 \times 10^8$ | Good print quality with no print defects |
| Invention Example 2 | Compliant layer (EA102, Kraton ® G1657, PP, & $TiO_2$) | 45.73 | $4.02 \times 10^8$ | Good print quality with no print defects |
| Invention Example 3 | Compliant layer (EA102, Kraton ® G1657, PS, & $TiO_2$) | 40.03 | $1.2 \times 10^8$ | Good print quality with no print defects |
| Comparative Example 4 | Compliant layer (PP, Vistamaxx ™ 6202, & $TiO_2$) | 11.38 | $1.19 \times 10^9$ | Fewer print defects than Comparative Example 3 |

* Properties of Support Coating on Imaging Side (compliant layer)
** "White spots" are also known as "drop-outs" where no image is present

TABLE II

| Imaging Element | Support Coating on Imaging Side | Skin Layer *** | Dye Receiving Layer (g/m$^2$) | Total Heat of Fusion * (J/g) | Print Defects |
|---|---|---|---|---|---|
| Invention Example 3 | Compliant layer (EA102, Kraton ® G1657, PS, & $TiO_2$) | Yes | 2.2 | 36.42 | Good print quality with no print defects |
| Invention Example 4 | " | No | " | 36.97 | " |
| Invention Example 5 | Compliant layer (EA102, Kraton ® G1657, PS, Topas, & $TiO_2$) | No | " | 38.83 | " |
| Invention Example 6 | Compliant layer (EA102, Kraton ® G1657, PP, & $TiO_2$) | No | 6.59 | 34.57 | " |
| Invention Example 7 | Compliant layer (EA102, Kraton ® G1657, PS, & $TiO_2$) | No | " | 32.61 | " |
| Invention Example 8 | Compliant layer (EA102, Kraton ® G1657, PP, Topas, & $TiO_2$) | No | 2.2 | 44.2 | " |

* Sum of Support Coating and skin layer (if any) and dye receiving layer on Image Side
*** Located between dye image receiving layer and compliant layer

TABLE III

| Imaging Element | Tensile Modulus * (dynes/cm$^2$) 25° C. | Total Heat of Fusion * (J/g) | $D_{max}$ Dye Density Change (% with respect to Comparative Example 1) |
|---|---|---|---|
| Comparative Example 1 | $8.08 \times 10^8$ | 93.17 | — |

TABLE III-continued

| Imaging Element | Tensile Modulus * (dynes/cm$^2$) 25° C. | Total Heat of Fusion * (J/g) | $D_{max}$ Dye Density Change (% with respect to Comparative Example 1) |
|---|---|---|---|
| Invention Example 3 | $1.2 \times 10^8$ | 40.03 | 17.2% |

TABLE III-continued

| Imaging Element | Tensile Modulus * (dynes/cm$^2$) 25° C. | Total Heat of Fusion * (J/g) | $D_{max}$ Dye Density Change (% with respect to Comparative Example 1) |
|---|---|---|---|
| Invention Example 9 | $8.06 \times 10^8$ | 11.89 | 46.1% |

* Properties of Support Coating on Imaging Side (compliant layer)

TABLE III lists the change in $D_{max}$ print density data for the standard set of printing conditions using a Kodak® 3480 on a Kodak® 6850 printer. Sixteen measurements of $D_{max}$ were taken and the change in print density as a function of total heat of fusion and tensile modulus are reported here. The data in TABLE III demonstrate that with a decrease in the heat of fusion, there is an increase in dye transfer efficiency (Invention Example 3 versus Comparative Example 1). Furthermore, a decrease in the heat of fusion and an increase in tensile modulus (Invention Example 9 versus Comparative Example 1) enhances the dye transfer efficiency. Thus, the best dye transfer efficiency occurs when extruded, non-voided compliant layer has a heat of fusion of from 0 to 30 joules/g of compliant layer and a tensile modulus value of from $1\times10^9$ to $5\times10^{10}$ dynes/cm$^2$.

The invention has been described in detail with particular reference to certain preferred embodiments thereof, but it will be understood that variations and modifications can be effected within the spirit and scope of the invention.

The invention claimed is:

1. An imaging element consisting essentially of a substrate and on the same surface, in order:

an extruded, non-voided compliant layer and an image receiving layer, and optionally a skin layer between the extruded, non-voided compliant layer and the image receiving layer, wherein the extruded, non-voided compliant layer has a heat of fusion of equal to or greater than 0 and up to and including 45 joules/g of compliant layer as determined in a temperature range of from 25° C. to 147° C. by ASTM method D3418-08, and a tensile modulus value of from $7\times10^7$ to $5\times10^{10}$ dynes/cm$^2$, wherein the extruded, non-voided compliant layer comprises at least one elastomeric resin in an amount of at least 5 weight %, and at least one amorphous or semi-crystalline polymer in an amount of at least 2 weight %.

2. The imaging element of claim 1 wherein the extruded, non-voided compliant layer has a heat of fusion of from about 5 to about 45 joules/g of compliant layer.

3. The imaging element of claim 1 wherein the extruded, non-voided compliant layer has a heat of fusion of from 0 to 30 joules/g of compliant layer and a tensile modulus value of from $1\times10^9$ to $5\times10^{10}$ dynes/cm$^2$.

4. The imaging element of claim 1 wherein the extruded, non-voided compliant layer comprises from about 35 to about 80 weight % of a matrix polymer, and comprises from about 5 to about 30 weight % of the elastomeric polymer and from about 2 to about 25 weight % of the amorphous or semi-crystalline polymer.

5. The imaging element of claim 1 wherein the elastomeric resin is a thermoplastic polyolefin blend, styrene/alkylene block copolymer, polyether block polyamide, thermoplastic copolyester elastomer, polyolefin, or thermoplastic urethane, or a mixture thereof.

6. The imaging element of claim 1 wherein the dry thickness ratio of the extruded, non-voided compliant layer to the substrate is from about 0.08:1 to about 0.5:1.

7. The imaging element of claim 1 further having an extruded skin layer immediately adjacent each side of the extruded, non-voided compliant layer.

8. The imaging element of claim 7 wherein the extruded skin layer(s) and extruded, non-voided compliant layer are co-extruded layers.

9. The imaging element of claim 1 wherein the extruded, non-voided compliant layer has a dry thickness of from about 15 to about 70 μm.

10. The imaging element of claim 1 wherein the substrate comprises cellulose fibers.

11. The imaging element of claim 10 wherein the substrate comprises raw paper stock comprising an antistatic agent.

12. The imaging element of claim 1 wherein the image receiving layer comprises a polyester, a polycarbonate, a vinyl polymer, or a combination thereof.

13. The imaging element of claim 1 wherein the image receiving layer and the extruded, non-voided compliant layers are co-extruded layers.

14. The imaging element of claim 1 that is dual-sided with an image receiving layer, an extruded, non-voided compliant layer, and optional skin layer, on each side of the substrate.

15. The imaging element of claim 1 wherein the image receiving layer is a thermal dye transfer image receiving layer and the imaging element is a thermal dye transfer receiver element.

16. An assembly comprising the imaging element of claim 1 and an image donor element.

17. The assembly of claim 16 wherein the imaging element is a thermal dye transfer receiver element and the image donor element is a thermal dye donor element.

18. A method of forming an image comprising imaging the imaging element of claim 1 in thermal association with an image donor element, wherein the imaging element is a thermal dye transfer receiver element and the image donor element is a thermal dye transfer donor element.

19. A thermal dye transfer element consisting essentially of a substrate comprising a raw paper base, and having on the same surface, only the following layers, in order:

a) an extruded, non-voided compliant layer comprising:

from about 35 to about 80 weight % of a matrix polymer derived at least in part from a polyolefin, from about 10 to about 25 weight % of at least one elastomeric polymer that is a thermoplastic polyolefin blend, styrene/alkylene block copolymer, polyether block polyamide, copolyester elastomer, ethylene/propylene copolymer, or thermoplastic urethane, and from about 5 to about 20 weight % of at least one amorphous or semi-crystalline polymer that is a polystyrene, polypropylene, or cyclic olefin copolymers, b) a thermal dye image receiving layer comprising a polyester, polycarbonate, vinyl polymer, or a combination thereof, and c) a co-extruded skin layer immediately adjacent on either or both sides of the extruded, non-voided compliant layer, wherein the extruded thermoplastic resin compliant layer has a heat of fusion of from 5 to 45 joules/g of compliant layer as determined in a temperature range of from 25° C. to 147° C. by ASTM method D3418-08, and wherein the dry thickness ratio of the extruded, non-voided compliant layer to the substrate is from 0.08:1 to 0.5:1.

* * * * *